US007946325B2

(12) United States Patent
Kawakubo et al.

(10) Patent No.: US 7,946,325 B2
(45) Date of Patent: May 24, 2011

(54) DEVICE AND METHOD FOR BLOCKING OPTICAL LENS

(75) Inventors: Jun Kawakubo, Tokyo (JP); Satoshi Annaka, Tokyo (JP)

(73) Assignee: Hoya Corporation, Tokyo (JP)

( * ) Notice: Subject to any disclaimer, the term of this patent is extended or adjusted under 35 U.S.C. 154(b) by 903 days.

(21) Appl. No.: 10/589,404

(22) PCT Filed: Feb. 18, 2005

(86) PCT No.: PCT/JP2005/002583

§ 371 (c)(1),
(2), (4) Date: Aug. 11, 2006

(87) PCT Pub. No.: WO2005/080047

PCT Pub. Date: Sep. 1, 2005

(65) Prior Publication Data

US 2007/0131351 A1 Jun. 14, 2007

(30) Foreign Application Priority Data

Feb. 20, 2004 (JP) ..... 2004-044194
Feb. 20, 2004 (JP) ..... 2004-044198

(51) Int. Cl.
*B05C 5/02* (2006.01)

(52) U.S. Cl. ..... 156/356; 156/357; 425/808; 451/390; 451/392; 451/393; 451/394; 451/395; 451/397; 451/398; 451/400; 451/402

(58) Field of Classification Search ..... 451/390, 451/392–395, 397, 398, 400, 402, 808; 425/808; 156/356, 357; 164/332, 334
See application file for complete search history.

(56) References Cited

U.S. PATENT DOCUMENTS 5,362,428 A * 11/1994 Tsujino et al. ..... 264/40.5
(Continued)

FOREIGN PATENT DOCUMENTS

JP 63-278756 A 11/1988
(Continued)

OTHER PUBLICATIONS

Machine Translation of JP 2003-071691.*

(Continued)

*Primary Examiner* — Richard Crispino
*Assistant Examiner* — Christopher Schatz
(74) *Attorney, Agent, or Firm* — Blakely, Sokoloff, Taylor & Zafman

(57) ABSTRACT

A centering device (13) is arranged to surround a loading table (11) on which a lens blank (1) is to be set, to set the geometric center of the lens blank (1) to coincide with the center of the loading table (11). The centering device (13) includes three clamp pins (31) which press the peripheral surface of the lens blank (1). When centering is ended, the loading table (11) on which the lens blank (1) is set is pushed up by a moving device (12) from a centering position ($H_1$) to a block position ($H_2$), and a peripheral portion of the lens blank (1) on a concave surface side is urged against the lower surfaces of locking portions (31A) of clamp pins (31). After a predetermined amount of wax (4) is dripped onto the lens blank (1), a lens holding unit (2) is moved downward by a predetermined amount and urged against the wax on the lens blank (1) to spread the wax thin and let the wax to solidify. Thus, the lens blank (1) and lens holding unit (2) are bonded to each other.

2 Claims, 10 Drawing Sheets

U.S. PATENT DOCUMENTS

| | | | | |
|---|---|---|---|---|
| 5,421,770 | A | 6/1995 | Bobst | |
| 6,918,822 | B2 * | 7/2005 | Arai et al. | 451/42 |
| 2003/0214058 | A1 * | 11/2003 | Belly et al. | 264/1.1 |

FOREIGN PATENT DOCUMENTS

| | | | |
|---|---|---|---|
| JP | 01-101319 | | 4/1989 |
| JP | 04-114766 | A | 4/1992 |
| JP | 08-112563 | | 5/1996 |
| JP | 09-290340 | A | 11/1997 |
| JP | 11-020037 | | 1/1999 |
| JP | 11-325828 | A | 11/1999 |
| JP | 2002-028842 | A | 1/2002 |
| JP | 2002-200547 | A | 7/2002 |
| JP | 2003-071691 | A | 3/2003 |
| JP | 2003-094309 | A | 4/2003 |
| JP | 2003-334748 | A | 11/2003 |
| WO | WO 0162439 | A1 * | 8/2001 |
| WO | WO 03/018254 | A | 3/2003 |

OTHER PUBLICATIONS

Machine Translation of JP 09-290340.*

* cited by examiner

DEVICE AND METHOD FOR BLOCKING OPTICAL LENS

The present patent application is a Utility of Application No. PCT/JP2005/002583, filed Feb. 18, 2005.

TECHNICAL FIELD

The present invention relates to a device and method for blocking an optical lens.

BACKGROUND ART

Conventionally, when manufacturing a spectacle lens from a circular lens base having an unfinished convex surface, it is fabricated by cutting or grinding the convex surface of the lens base into a predetermined surface shape by a numerically controlled grinding machine, e.g., a versatile polishing apparatus TORO-X2SL manufactured by LOH, to have a thickness slightly larger than the finishing size including the lapping stock or polishing stock, and then polishing the convex surface into a predetermined curved surface by the polishing apparatus.

According to U.S. Pat. No. 5,421,770, in cutting or polishing a lens base, the lens base is attached to a polishing apparatus through a lens holding tool which is bonded to a non-polishing surface.

According to the present invention, in the following description, the lens base will be referred to as a lens blank, and the lens holding tool will be referred to as a lens holding unit. To fix the lens blank to the lens holding unit through a bonding agent will be referred to as blocking or block. A device that performs such blocking or block will be referred to as a blocking device. As the blocking device, for example, a device called a layout blocker manufactured by LOH is known.

Concerning blocking a lens blank, in the blocking device disclosed in Japanese Patent Laid-Open No. 2003-334748, as shown in FIG. 13, a lens blank 1 is disposed above a lens holding unit 2 through a blocking ring 3. A molten bonding agent 4 is poured into the space surrounded by three members, i.e., the lens blank 1, lens holding unit 2, and blocking ring 3, and cooled to solidify so as to block the lens blank 1 by the lens holding unit 2. As the bonding agent, generally, an alloy or wax having a low melting point is employed.

In this blocking device, different types of lens holding units 2 and blocking rings 3 are prepared to correspond to the types of the lens blanks 1. In blocking, a lens holding unit 2 and blocking ring 3 corresponding to the employed lens blank 1 are selected and used so the center of the bonding agent 4 has a predetermined thickness. In FIG. 13, reference numeral 5 denotes a table; and 6, a fixing means for fixing the blocking ring 3 to the table 5.

When the lens blank 1 is to be blocked by the lens holding unit 2, the center of the lens blank 1 must accurately coincide with the center of the lens holding unit 2. For this purpose, in the centering devices disclosed in Japanese Patent Laid-Open No. 09-290340, 11-325828, and the like, the lens blank 1 is clamped and centered with respect to the lens holding unit 2.

The centering device described in Japanese Patent Laid-Open No. 09-290340 is a device that mechanically centers a lens with reference to its peripheral surface. During blocking, a ring member surrounding the lens is pivoted to urge the holding portions of three lever members against the peripheral surface of the lens so as to center the lens.

Japanese Patent Laid-Open No. 11-325828 relates to a measuring method and apparatus with which, to an optical component having a concave surface, e.g., a concave lens or concave mirror, the center position of the concave surface and the center position of the outer shape of the optical component are obtained. According to this apparatus, the edge portion of the concave surface of the optical surface is cut to form a flat surface. The coordinates of at least three points on a circle surrounded by the flat surface are measured by a differential interference microscope and a distance measuring device which measures the moving amount of a moving table. The center position of the circle is calculated from the measured coordinates, and the calculated center position is determined as the center position of the concave surface.

DISCLOSURE OF THE INVENTION

Problem to be Solved by the Invention

The centering device described in Japanese Patent Laid-Open No. 09-290340 requires a large number of components, e.g., a cylindrical member having a guide portion and cam surface, a ring member, three rollers, three lever members, a biasing means, a holding portion releasing means, and the like. Accordingly, the structure of this centering device is complicated to lead to a high manufacturing cost. This centering device is thus not practical.

The optical component measuring apparatus described in Japanese Patent Laid-Open No. 11-325828 is formed of an X-moving table and Y-moving table which move the moving table, on which the optical component is to be placed, in orthogonal directions. The moving amounts of the X- and Y-moving tables are measured by the distance measuring device. Signals corresponding to the moving amounts of the respective moving tables transmitted from the distance measuring device are calculated by an arithmetic operation unit to obtain the center position and eccentric direction of the optical component. Therefore, the apparatus itself is expensive. Development of an inexpensive centering device is thus sought for.

During centering, as the accuracy of the lens block directly influences the lens machining accuracy, high accuracy is required. Because a large number of types of lens blanks 1 are employed, however, conventionally, the blocking operation is manually performed by the operator. Hence, high accuracy cannot be obtained, and the burden to the operator increases. Moreover, it is very difficult to control the supply amount of bonding agent 4 highly accurately. More specifically, when aligning the lens blank 1 and lens holding unit 2, the operator aligns them by visual observation such that the difference between the diameter of the blocking ring 3 and that of the blank becomes equal throughout the entire periphery, or the operator adjusts the movement of the lens blank 1 such that the periphery of the lens blank 1 image-sensed by a CCD camera coincides with the reference line displayed on the same monitor that displays the lens blank 1, thus securing the blocking accuracy. This position adjusting operation varies depending on the operator to lead to poor accuracy, causing an error. Also, the operation poses a heavy burden to the operator and is thus time-consuming.

In blocking the lens blank 1, when the lens blank 1 is placed on the table or the like with its blocking target surface facing up, the height of the optical surface to be blocked changes depending on the thickness of the peripheral edge of the lens blank 1. Thus, the blocking ring 3 that matches the thickness of the peripheral edge of the lens blank 1 is required. As a result, the number of types of the blocking rings 3 increases, and storage and management of the blocking rings 3 are cumbersome.

Conventionally, the lens blank 1 is placed on the blocking ring 3 in advance. A predetermined gap is set between the lens blank 1 and lens holding unit 2. The bonding agent 4 is poured into the gap and cooled to solidify. If the gap at the center is excessively narrow, the bonding agent 4 cannot reach the center readily, thus causing a dioptric power error. On the contrary, if the gap is excessively wide, the use amount of wax 4 increases inevitably. The influence of heat shrinkage thus increases, and the lens dioptric power becomes unstable. Therefore, the use amount and thickness of the bonding agent 4 must be controlled highly accurately. The melt temperature of the bonding agent 4 itself is about 50° C. to 80° C. While the bonding agent 4 is being poured into the gap, if the bonding gent 4 is deprived of heat by the lens holding unit 2 or lens blank 1 and is cooled to solidify, it cannot cover the entire blocking surface of the lens holding unit 2, and a sufficient bonding strength cannot be obtained.

If the bonding agent 4 starts to solidify before its supply operation has not been ended yet, bubbles are generated in the bonding agent 4. In this case as well, the bonding agent 4 does not cover the entire blocking surface of the lens holding unit 2, and a sufficient bonding strength cannot be obtained.

In the operation of supplying the bonding agent 4 into the gap between the lens blank and lens holding unit, usually, the operator presses a button to pour the bonding agent 4 into the gap. The operator stops supplying the bonding agent after he or she visually confirms that the poured bonding agent 4 has reached a predetermined amount. This increases burden to the operator. Moreover, the supply amount is not stable. If the supply amount is excessively large, the bonding agent 4 overflows from the gap between the lens blank 1 and lens holding unit 2 and attaches to the peripheral surface or concave surface of the lens blank 1. If the supply amount is excessively small, sufficient bonding power cannot be obtained. In this manner, various problems arise.

The present invention has been made to solve the conventional problems as described above, and has as its object to provide a device for blocking an optical lens, which does not require a blocking ring and can move even optical lenses having peripheral portions with different thicknesses to a predetermined block position reliably.

It is another object of the present invention to provide a device for blocking an optical lens which can reliably center the optical lens by a simple centering device.

It is still another object of the present invention to provide a device and method for blocking an optical lens which can control the supply amount and thickness of a bonding agent that match the size, shape, and the like of the optical lens highly accurately.

Means of Solution to the Problem

In order to achieve the above objects, according to the first invention, there is provided a device for blocking an optical lens, comprising a lens holding tool to which the optical lens is to be fixed through a bonding agent, comprising a loading table on which the optical lens is to be placed with a concave surface thereof facing up, a centering device which causes a geometric center of the optical lens to coincide with a center of the loading table, a dripping device which drips the bonding agent onto the concave surface of the optical lens, and a moving device which moves the optical lens to a block position of the lens holding tool.

According to the second invention, there is provided a method for blocking an optical lens, of interposing a molten bonding agent between the optical lens and a lens holding tool and letting the molten bonding agent to solidify so as to fix the optical lens to the lens holding tool, comprising the steps of dripping the bonding agent onto a concave surface of the optical lens, urging the lens holding tool against the bonding agent on the optical lens to spread the bonding agent so as to hold the lens holding tool and the optical tool at a predetermined gap, and cooling the bonding agent to solidify so as to integrally bond the lens holding tool and the optical lens.

Effects of the Invention

The first invention comprises the moving device which moves the optical lens to the block position. Thus, various types of optical lenses having peripheral edges with different thicknesses can be moved to the block position reliably and blocked by the lens holding tool.

Also, the supply amount of bonding agent can be controlled by the dripping device highly accurately. Therefore, the bonding agent does not overflow from the concave surface, and no blocking ring need be employed.

According to the second invention, as the bonding agent is dripped onto the lens concave surface by the dripping device, the dripping amount of bonding agent can be controlled correctly. The dripping amount of bonding agent may be calculated and determined in advance on the basis of the shapes of the optical lens and lens holding tool, and the like.

When the moving mounts of the optical lens and lens holding tool in directions to relatively approach each other are controlled correctly, a predetermined gap can be set between the blocking surface of the lens holding tool and the lens concave surface.

After the bonding agent is dripped onto the concave surface of the optical lens, the dripped bonding agent is pressed and spread into a predetermined thickness by the lens holding tool. No bubbles will be formed in the bonding agent, and high bonding strength can be obtained. The bonding agent will not overflow outside the lens concave surface to contaminate the optical lens or devices. The bonding agent will not become short to block the optical lens insufficiently. Therefore, a blocking ring which surrounds the lens holding tool need not be used, so the number of components can be decreased.

BEST MODE FOR CARRYING OUT THE INVENTION

Figure 1:
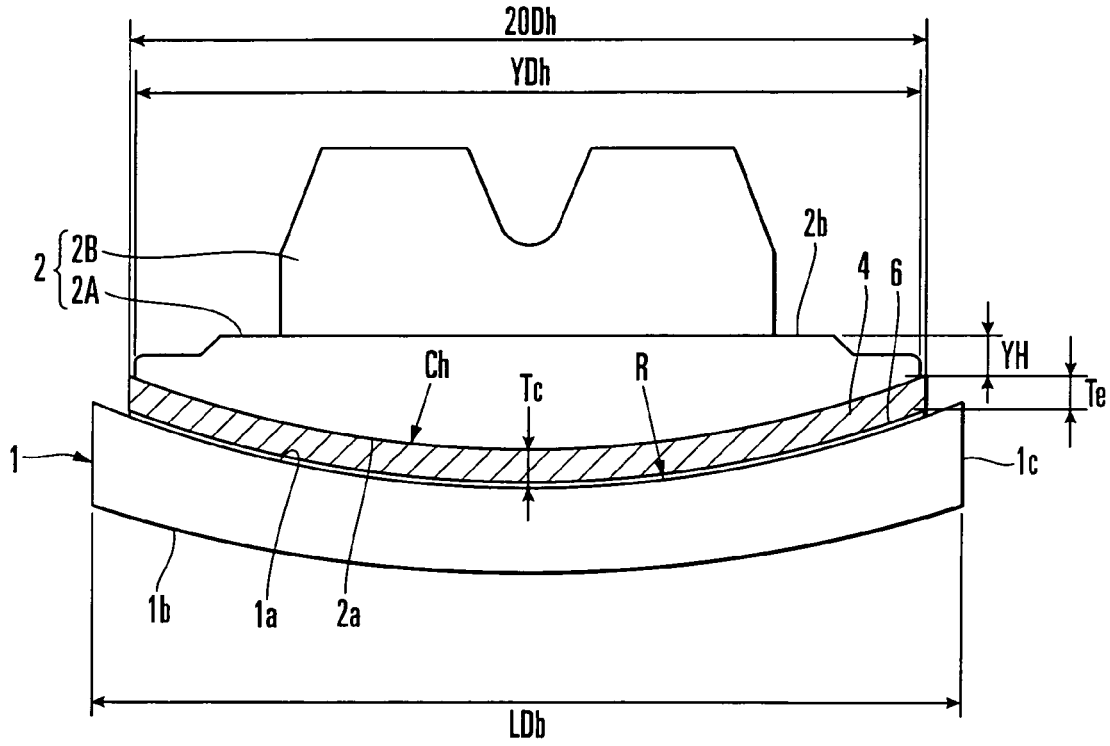
FIG. 1 is a view showing a state wherein a lens blank is blocked by a lens holding unit.

The present invention will be described in detail based on the embodiment shown in the drawings.

Referring to FIG. 1, reference numeral 1 denotes a lens blank; 2, a lens holding unit serving as a lens holding tool; 4, a bonding agent to integrally bond the lens blank 1 to the lens holding unit 2; and 6, a protective film.

The lens blank 1 is a plastic semifinished lens and is fabricated from, e.g., a diethylene-grycol-bisallyl-carbonate-based resin (refractive index=1.50), an urethane-based resin, an epithio-based resin (refractive index=1.55 to 1.75), or the like. A concave surface 1*a* of the lens blank 1 is formed of an optical surface having a predetermined radius of curvature, and serves as a block target surface to be blocked by the lens holding unit 2. A convex surface 1*b* is a polishing target surface which is polished by a polishing machine, after the block target surface 1*a* of the lens blank 1 is blocked by the blocking device according to the present invention, so it is finished into a predetermined optical surface. When the lens blanks 1 are classified according to their sizes, they have four types of diameters LDb, e.g., 80 mm, 75 mm, 70 mm, and 65 mm.

The lens holding unit 2 which blocks the lens blank 1 is formed of an Al disk 2A with a maximal diameter YDh which is smaller than the diameter LDb of the lens blank 1, and a SUS303-made annular projection 2B which integrally projects on the center of the rear surface of the disk 2A. A front surface 2*a* of the disk 2A is a blocking surface to block the lens blank 1, and is formed of a convex surface with a radius Ch of curvature which is substantially equal or close to a radius R of curvature of the concave surface 1*a* of the lens blank 1. A thin oxide film is formed on the entire surface of the front surface 2*a* by anodization. In this embodiment, the blocking surface 2*a* is colored by utilizing pores in the oxide film formed by anodization. A rear surface 2*b* of the disk 2A forms a reference surface which is referred to when mounting the lens holding unit 2 to the polishing device or cutting device. The projection 2B forms a fitting portion to fit with the chuck of the polishing device or cutting device.

Such a lens holding unit 2 is prepared in a plurality of types to correspond to the types of the lens blanks 1, as shown in, e.g., Table 1. More specifically, regarding the types of the lens holding units 2, four different diameters YDh are available (80 mm, 75 mm, 70 mm, and 65 mm), and five different radii Ch of curvature of the blocking surfaces 2*a* are available (R162, R105, R76, R61, and R55), providing a total of 16 types that are made up from combinations of different diameters YDh and different radii Ch of curvature of the blocking surface 2*a*. In blocking, among the lens holding units 2, one having a radius Ch of curvature and diameter YDh which are equal or similar to the radius R of curvature and diameter LDb of the concave surface 1*a* of the lens blank 1 is selectively used. When the lens holding unit 2 is selected in this manner to correspond to the lens blank 1 so the shape of the blocking surface 2*a* of the lens holding unit 2 substantially coincides with the shape of the concave surface 1*a* of the lens blank 1, the gap between the concave surface 1*a* and blocking surface 2*a* can be set substantially constant throughout the entire surface. Thus, the bonding gent 4 can be supplied in an appropriate amount, and the cooling time of the bonding agent 4 can be shortened.

TABLE 1

| Radius mm of Curvature (Preset Color) | Diameter (mm) of Lens holding unit | | | |
|---|---|---|---|---|
| | ϕ 80 | ϕ 75 | ϕ 70 | ϕ 65 |
| R162 (Green) | ○ | ○ | ○ | ○ |
| R105 (Blue) | ○ | ○ | ○ | ○ |
| R76 (Red) | ○ | ○ | ○ | ○ |
| R61 (Orange) | x | ○ | ○ | ○ |
| R55 (White) | x | x | x | ○ |

Note:
○ = preset, x = not preset

As the bonding agent 4, wax or a low-melting alloy (e.g., a Bi, Pb, Sn, Cd, or In alloy having a melting point of 47° C.) is employed. This embodiment will be described exemplifying a case which uses highly viscous wax (with a suitable use temperature of 70° C. to 80° C.). The wax 4 is a compound mainly made of polyethylene wax and contains hydrocarbon ($C_nH_{2n}$) as a main component. The physical properties of the wax 4 include a softening point of 57° C., a flash point of 300° C., a density of 0.92 g/cm$^2$ (25° C.), and a viscosity of 330 mPa·s (100° C.). The wax 4 is insoluble to water.

When blocking the lens blank 1 by the lens holding unit 2, it is usually blocked through the protective film 6. The protective film 6 is employed to prevent the concave surface 1*a* of the lens blank 1 from being damaged during polishing and facilitate removal of the wax 4. As the protective film 6, for example, one having a three-layer structure including a surface layer, intermediate layer, and adhesive layer is employed. When the protective film 6 as a three-layer structure, the surface layer and intermediate layer are made of polyethylene, and the adhesive layer is made of polyolefin. The thicknesses of the surface layer, intermediate layer, and adhesive layer are about 10 μm, 85 μm, and 25 μm, respectively. Regarding the physical properties of the protective film 6, the protective film 6 is a film-like solid at room temperature and has a melting point of 110° C. to 130° C. and a specific gravity of 0.9 to 1.0.

Another example of the protective film 6 may have a two-layer structure including a base layer made of polyethylene and an adhesive layer made of polyolefin. Regarding the physical properties of this protective film 6, the protective film 6 is a film-like solid at room temperature and has a melting point of 110° C. to 130° C. and a specific gravity of 0.9 to 1.0.

Figure 2:
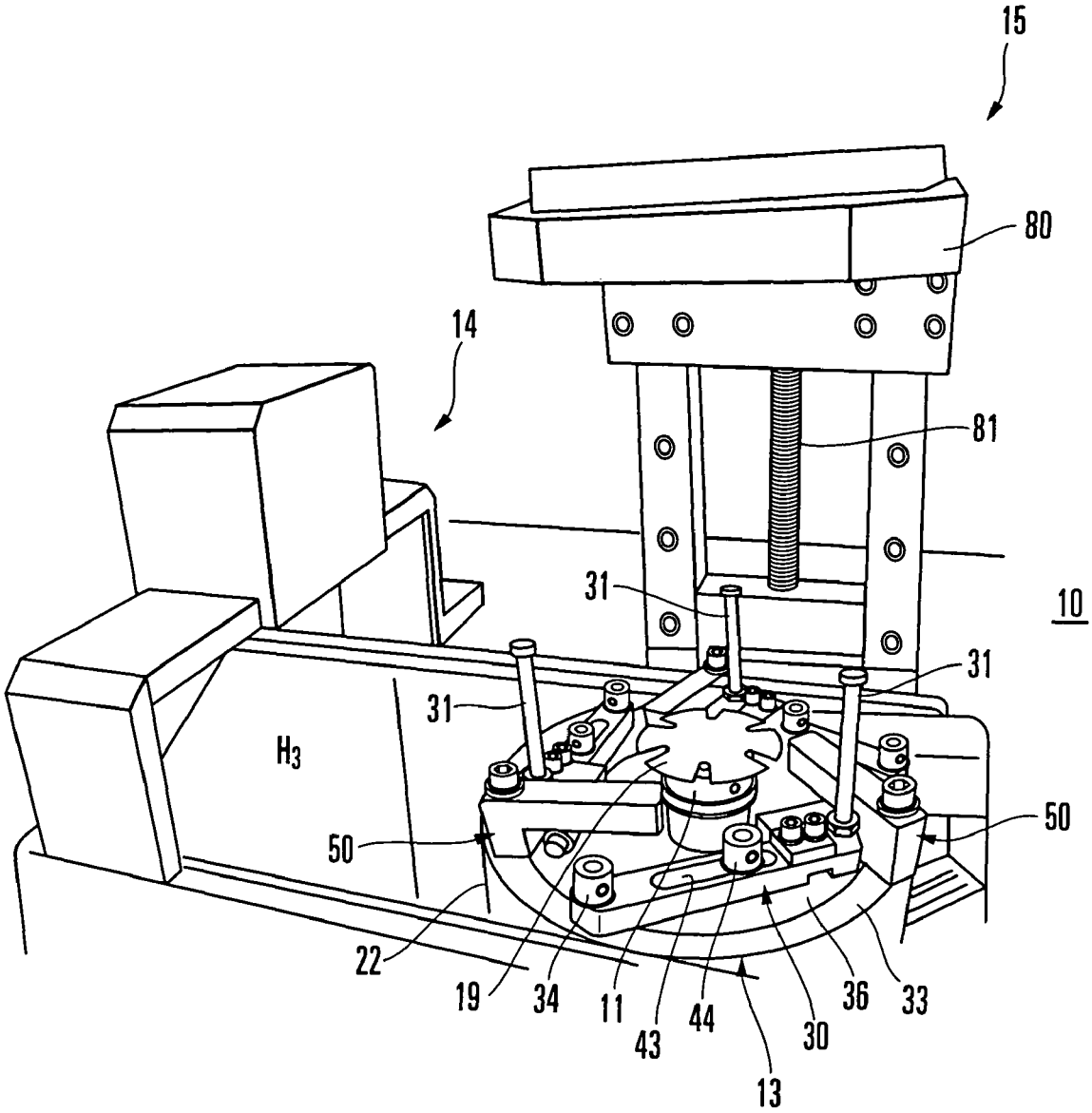
FIG. 2 is a perspective view of the appearance of the main part of a blocking device according to the present invention.

Referring to FIG. 2, a blocking device denoted by reference numeral 10 is a device that blocks the lens blank 1 by the lens holding unit 2. The blocking device 10 comprises a loading table 11 on which the lens blank 1 is to be placed, a moving device 12 (FIG. 4) which moves the lens blank 1 from a centering position $H_1$ to a block position $H_2$ (FIG. 5) during blocking, a centering device 13 which centers the lens blank 1, a dripping device 14 which drips the wax 4 onto the lens blank 1, a gap setting device 15 which sets a predetermined gap between the lens blank 1 and lens holding unit 2 during block, a controller (not shown) which controls the entire blocking device, and the like.

Figure 4:
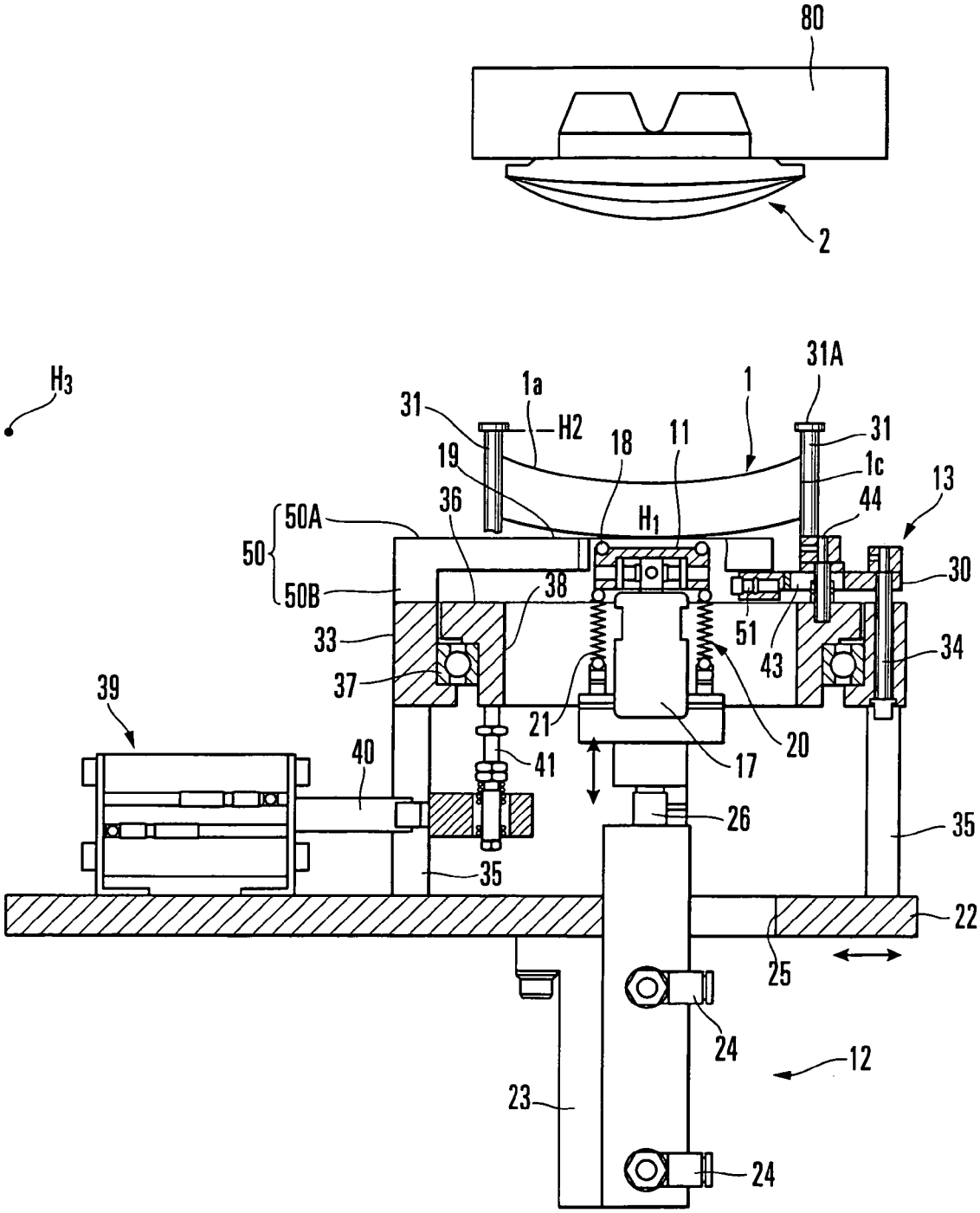
FIG. 4 is a sectional view of the centering portion.

Referring to FIG. 4, the loading table 11 is attached to the upper end face of a vertically movable support shaft 17. A pad 19 is placed on the upper surface of the loading table 11 through an O-ring 18. The pad 19 is employed to facilitate movement of the lens blank 1 during centering. The loading table 11 is attached to the support shaft 17 to be able to be swung (be swiveled) in all directions by a swing means 20 so the loading table 11 can cope with the various types of lens blanks 1. Hence, even if the lens blank 1 has an extremely prismatic shape and the thickness of its peripheral portion changes in the circumferential direction, when the loading table 11 is inclined by the swing means 20 with respect to the horizontal plane to abut the peripheral edge of the lens blank 1 on the concave surface 1*a* side against the lower surfaces of locking portions 31A of three pins (to be referred to as clamp pins hereinafter) 31 (to be described later), the concave surface 1*a* of the lens blank 1 can be held horizontally. The swing means 20 further comprises a plurality of tensile coil springs 21 arranged around the support shaft 17. The tensile coil springs 21 bias the loading table 11 downward.

The moving device 12 which moves the lens blank 1 from the centering position $H_1$ to the block position $H_2$ is formed of an air cylinder with speed controllers 24 which is attached to the lower surface of a slide plate 22 through a bracket 23 to face upward. The moving device 12 vertically moves the support shaft 17 by a stretchable operational rod 26.

The slide plate 22 has an insertion hole 25 through which the moving device 12 extends. The slide plate 22 is reciprocally moved by a driving device such as a cylinder (not shown) between a position below the centering position $H_1$ (FIG. 4) and a position below a dripping position $H_3$ (FIG. 2) of the wax 4.

The centering position $H_1$ of the blocking device 10 is where the lens blank 1 is centered by the centering device 13. The centering position $H_1$ is a position on the upper surface of the loading table 11 which is on the right of the dripping device 14 and in front of the gap setting device 15 in FIG. 2. The block position $H_2$ is a position above the centering position $H_1$. At the block position $H_2$, a peripheral edge 11*a* (FIG. 5) of the lens blank 1 on the concave surface 1*a* side is locked by the locking portions 31A of the clamp pins 31. The block position $H_2$ is set above the centering position $H_1$ in order that whichever one of the various types of lens blanks 1 having peripheral portions with different thicknesses may be employed, the peripheral edge 11*a* of the lens blank 1 on the concave surface 1*a* side can be positioned at a predetermined height during block. The dripping position $H_3$ is where the wax 4 is dripped onto the concave surface 1*a* of the lens blank 1 by the dripping device 14. The dripping position $H_3$ is on the left of the block position $H_2$ and has the same height as that of the block position $H_2$.

Figure 3:
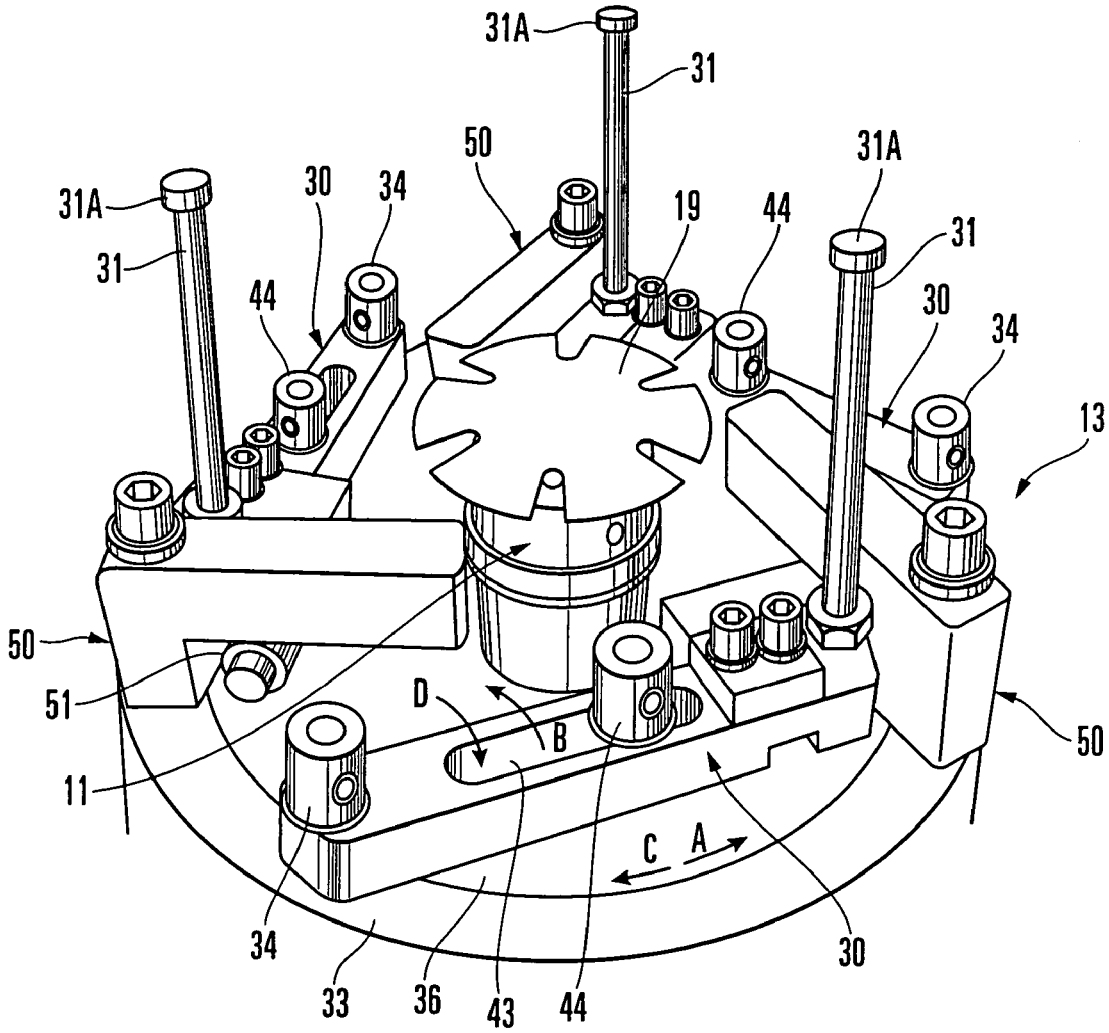
FIG. 3 is a perspective view of the centering portion of the blocking device.

Referring to FIGS. 3 and 4, the centering device 13 is a mechanism that centers the lens blank 1 to set the geometric center of the lens blank 1 to coincide with the center of the loading table 11. The centering device 13 comprises three clamp members 30 disposed around the loading table 11, and the three clamp pins 31 which project on the respective clamp members 30. The proximal ends of the clamp members 30 are axially supported by stationary shafts 34, projecting on the upper surface of a clamp base 33, to be pivotal in the radial direction (directions of arrows B and D) of the clamp base 33. The clamp pins 31 project on the distal ends of the respective clamp members 30. The stationary shafts 34 project on the clamp base 33 equidistantly in the circumferential direction.

Figure 5:
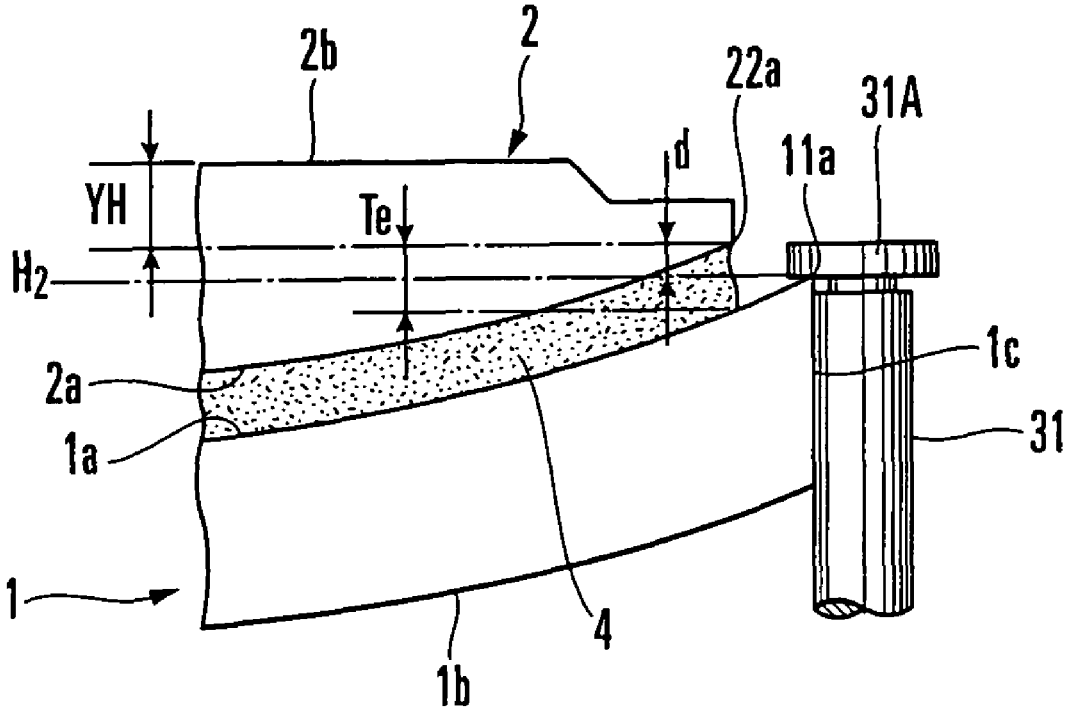
FIG. 5 is a view showing a state wherein the lens blank is locked at a block position.

All the clamp pins 31 have the same length, and the locking portions 31A integrally project on the upper ends of the respective clamp pins 31, as shown in FIG. 5. Each locking portion 31A forms a disk larger in diameter than the corresponding clamp pin 31. The lower surface of the locking portion 31A forms a surface that receives the peripheral edge 11*a* of the lens blank 1 on the concave surface 1*a* side to define the limit of the upward movement of the lens blank 1. The height of the lower surface of the locking portion 31A corresponds to the block position $H_2$ where the lens holding unit 2 blocks the lens blank 1.

The clamp base 33 forms a cylindrical shape having upper and lower open ends, and is horizontally fixed on a plurality of columns 35 projecting on the upper surface of the slide plate 22. A rotary base 36 is rotatably built into the clamp base 33 through a bearing 37. The rotary base 36 has a through hole 38 which forms a cylinder and through which the support shaft 17 extends. When the centering device 13 is to center the lens blank 1, the rotary base 36 is reciprocally pivoted through a predetermined angle by an air cylinder 39.

As the air cylinder 39, a direct coupled type air cylinder is employed. The linear reciprocal motion of a rod 40 of the air cylinder 39 is converted into an arc motion. The arc motion is transmitted to the rotary base 36 through a shaft 41.

Three moving shafts 44 project on the upper surface of the rotary base 36 equidistantly in the circumferential direction. Each moving shaft 44 slidably extends through an elongated hole 43 formed at the center of the corresponding clamp member 30 and projects upward. During centering the lens blank 1, when the rotary base 36 is pivoted by the air cylinder 39 in a direction of an arrow A (counterclockwise) in FIG. 3, the lens blank 1 can be centered by the clamp pins 30. More specifically, when the rotary base 36 pivots in the direction of the arrow A, the moving shafts 44 move in the corresponding elongated holes 43 in a direction to be spaced apart from the stationary shafts 34, and pivot the clamp members 30 in the direction of the arrow B about the stationary shafts 34 as pivot centers. Thus, the clamp pins 31 also pivot in the same direction. When the clamp members 30 pivot through a predetermined angle, the clamp pins 31 abut against a peripheral surface 1*c* of the lens blank 1 on the loading table 11 to press the lens blank 1. When the geometric center of the lens blank 1 is eccentric from the center of the loading table 11, the lens blank 1 is moved by the three clamp pins 31 in a direction opposite to the eccentric direction and is centered, so the geometric center of the lens blank 1 coincides with the center of the loading table 11.

When centering of the lens blank 1 is ended, the driving operation of the air cylinder 39 is switched to pivot the rotary base 36 in a direction of an arrow C. When the rotary base 36 rotates in the direction of the arrow C, the respective clamp members 30 pivot through the same angle in the opening direction (in the direction of the arrow D) and are restored to the home positions so as to separate all the clamp pins 31 away from the lens blank 1.

Furthermore, three positioning blocks 50 are arranged on the upper surface of the clamp base 33 such that each positioning block 50 is located between the adjacent clamp members 30 in front of and behind it and is substantially perpendicular to the clamp member 30 behind it. Each positioning block 50 is formed into an inverted-L shape to have an arm 50A and leg 50B. The arm 50A extends above the rotary base 36 to be parallel to and oppose it. The leg 50B is fixed to the upper surface of the clamp base 33 with a bolt.

Bearings 51 (FIG. 3) to be interposed between the rotary base 36 and the arms 50A of the respective positioning blocks 50 are attached to the distal ends of the respective clamp members 30. During centering, the bearings 51 roll on the rotary base 36 to smooth the pivot of the corresponding clamp members 30 in the directions of the arrows B and D in FIG. 3. When the lens blank 1 is moved upward together with the loading table 11 and is urged against the locking portions 31A of the clamp pins 31, the bearings 51 are urged against the lower surfaces of the arms 50A of the positioning blocks 50 to prevent the clamp members 30 from suspending.

Figure 6:
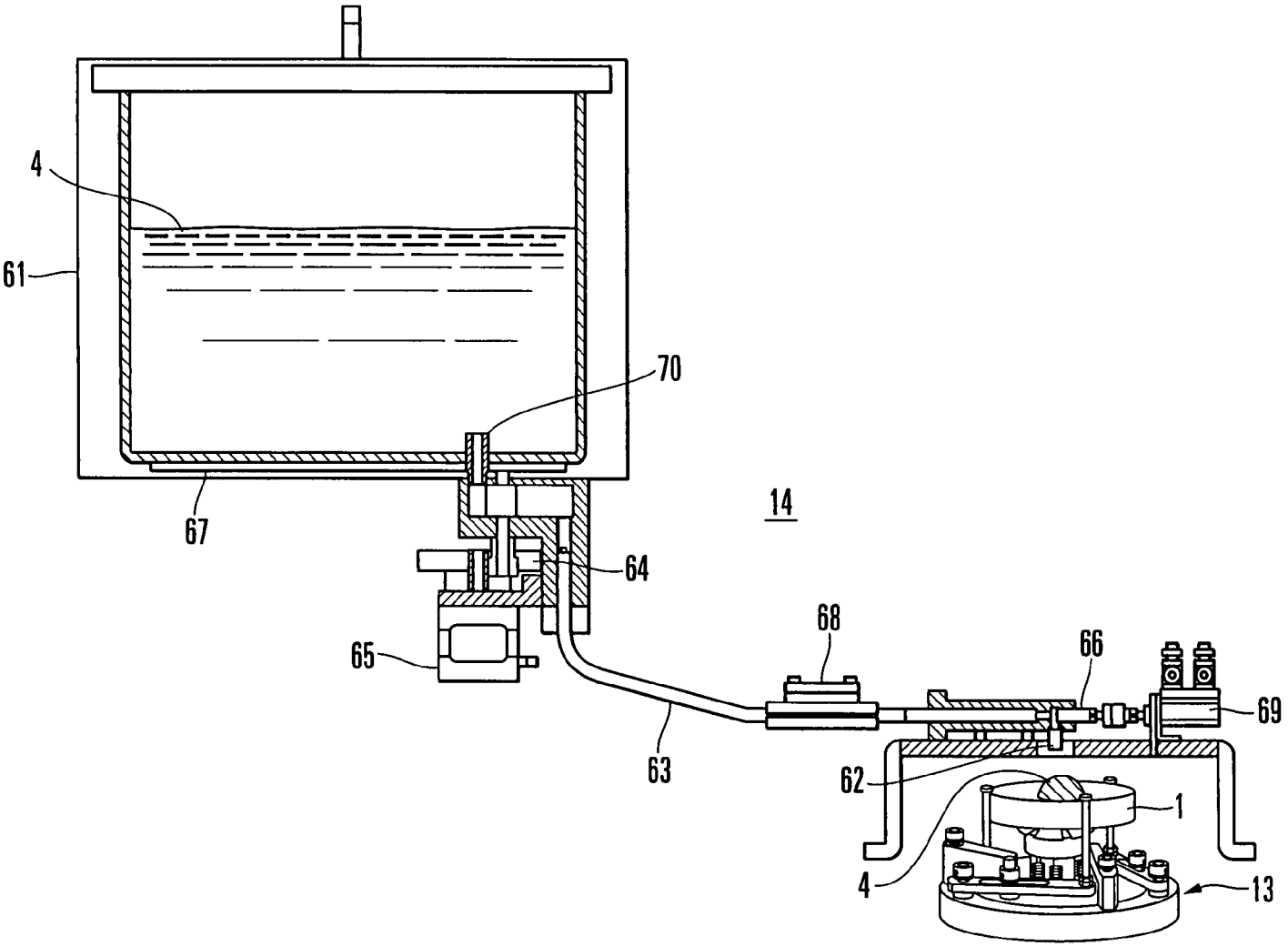
FIG. 6 is a view showing a dripping device.

Referring to FIG. 6, the dripping device 14 which drips the wax 4 onto the concave surface 1*a* of the lens blank 1 comprises a tank 61 which stores the wax 4, a nozzle 62 which drips the wax 4 onto the lens blank 1, a pipe 63 which connects the tank 61 to the nozzle 62, a pump 64 which feeds out the wax 4 in the form of batches each having a predetermined amount from the tank 61 intermittently, a stepping motor 65 which drives the pump 64, a dripping valve 66 which opens/closes the nozzle 62, heaters 67 and 68 which heat the tank 61 and pipe 63, respectively, an air cylinder 69 with a speed controller which operates the dripping valve 66, and the like.

The volume of the tank 61 is 10.56 liters (440-mm width×240-mm depth×100-mm height). The heater 67 of the tank 61 is of 100 V and 300 W. The heater 68 of pipe 63 is of 100 V and 17 W. The nozzle 62 has an opening with a diameter of 3 mm. As the dripping valve 66 which opens/closes the nozzle 62, a pin cylinder (CDJPL10-5D-97LS) manufactured by SMC is employed.

When the wax 4 in a solid state is charged into the tank 61, it is heated and melted by the heater 67. The temperature in the tank 61 is controlled by a temperature controller. The temperature controller is automatically turned on/off at time preset by a timer switch. It takes two hours for the heater 67 to melt the wax 4 in the solid state in the tank 61 by heating to 70° C. When the wax 4 is melted in advance by using the timer, at the start of the operation, the block operation for the lens blank 1 can be started without waiting for melting the wax 4.

The temperature of the dripping device 14 at which the molten material can be used is 0° C. to 120° C., and the melt temperature of the wax 4 is suitably 68° C. to 72° C. Both temperatures are preferably held at constant values. When the molten wax 4 in the tank 61 is fed out every a predetermined amount intermittently from a discharge port 70 by the pump 64, it is guided to the nozzle 62 through the pipe 63.

Figure 7:
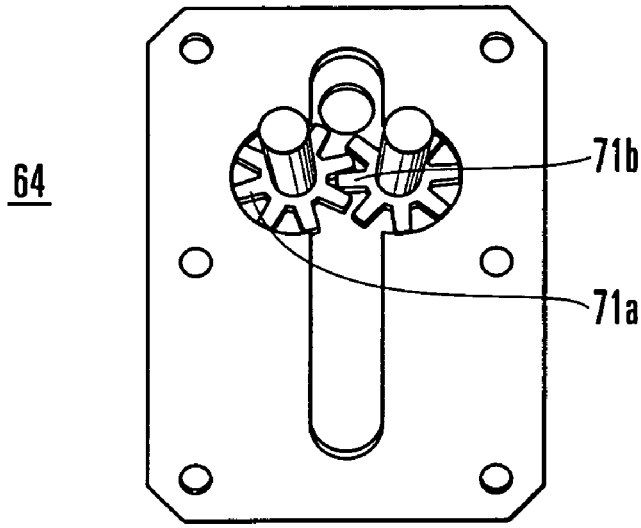
FIG. 7 is a view showing the interior of a gear pump.

As the pump 64, a known gear pump which uses two gears 71*a* and 71*b* that mesh with each other is employed, as shown in FIG. 7. Such a gear pump 64 is suitable because it can supply the viscous wax 4 in the form of batches each having the predetermined amount smoothly and reliably. The amount of wax 4 to be fed out by the gear pump 64 is controlled correctly by changing the number of driving pulses to be supplied to the stepping motor 65.

Figure 8:
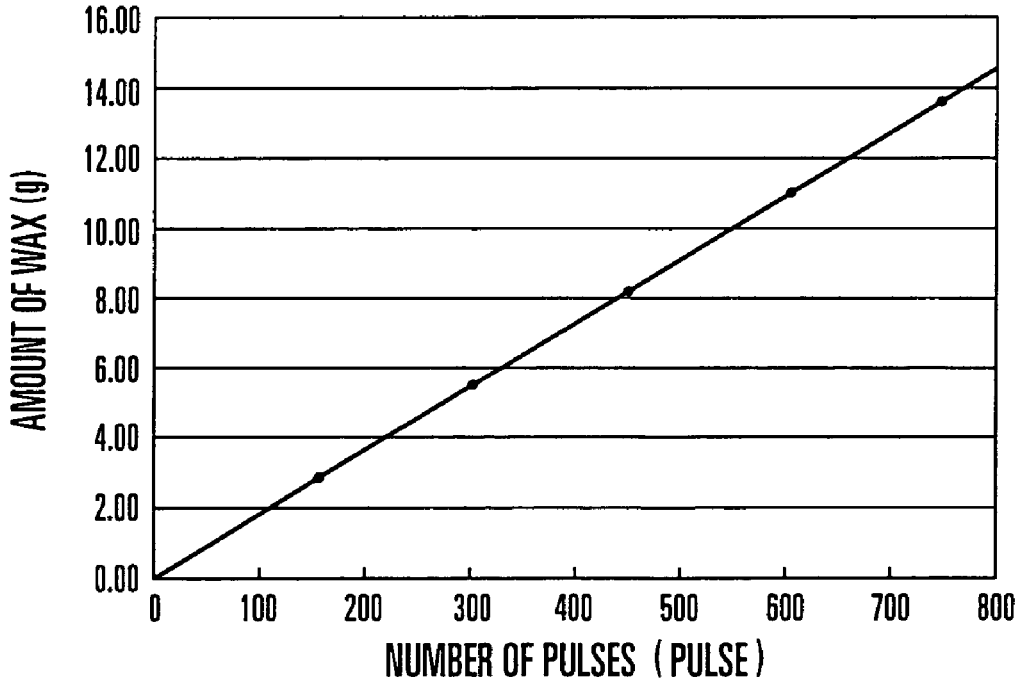
FIG. 8 is a graph showing the relationship between the dripping amount of wax and the number of pulses to be supplied to a stepping motor.

FIG. 8 is a graph showing the relationship between the number of pulses to be supplied to the stepping motor 65 and the dripping amount of wax 4. As is apparent from FIG. 8, the dripping amount of wax 4 exhibits very high linearity with respect to the number of pulses.

Figure 13:
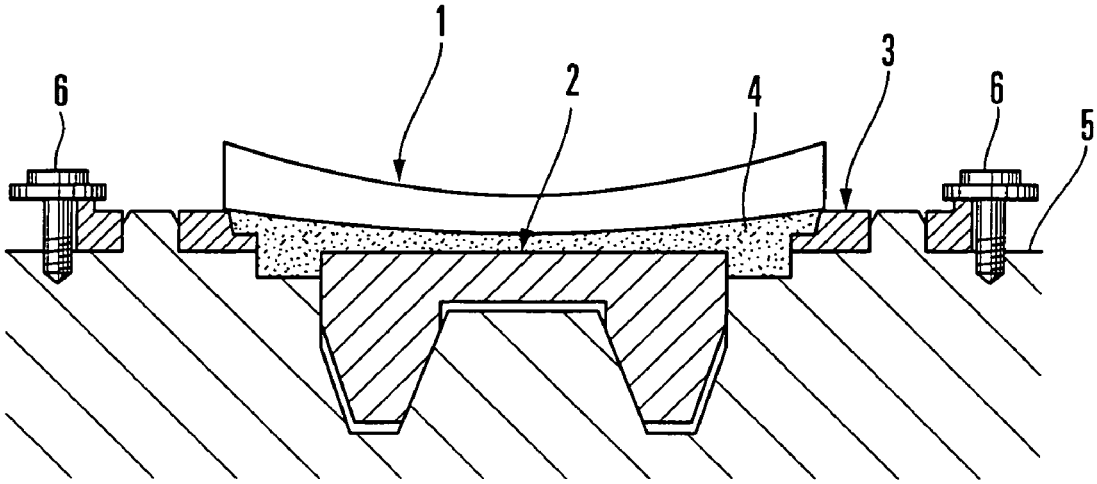
FIG. 13 is a sectional view showing a conventional case wherein a lens blank is to be blocked using a blocking ring.

To control the dripping amount of wax 4 is a significant factor in implementing the dripping device 14 that does not require the conventional blocking ring 3 shown in FIG. 13. If the dripping amount cannot be controlled correctly, when the dripping amount is excessively large, the wax 4 overflows from the concave surface 1*a* of the lens blank 1. When the dripping amount is excessively small, the holding force of the block decreases. According to the present invention, the on/off time of the dripping valve 66 is controlled in accordance with the lens blank 1, so the dripping amount of wax 4 can be controlled highly accurately. The problem of low block holding force thus does not arise, and optimal amounts of wax 4 can be dripped to correspond to the various types of lens blanks 1.

Referring to FIGS. 2 and 4 again, the gap setting device 15 which vertically moves the lens holding unit 2 to set a predetermined gap between the lens holding unit 2 and lens blank 1 comprises a holding arm 80 which holds the lens holding unit 2, a ball screw 81 which supports the holding arm 80 to be vertically movable, a stepping motor (not shown) which rotates the ball screw 81, and the like, and is arranged behind the centering device 13. The distal end of the holding arm 80 stretches forward to be located above the block position $H_2$, and is provided with a vacuum chuck (not shown), which detachably holds the lens holding unit 2, at its lower surface. The center of the vacuum chuck coincides with the center of the loading table 11. During block of the lens blank 1, when the holding arm 80 is moved downward by the rotation of the ball screw 81, the lens holding unit 2 is urged against the wax 4 which has been dripped onto the lens blank 1. Thus, the wax 4 spreads thinly over the entire surface of the block surface 2*a* of the lens holding unit 2, to enable blocking of the lens blank 1 by the lens holding unit 2.

The amount of downward movement of the lens holding unit 2 during block is controlled correctly by the number of pulses which are supplied to the stepping motor with reference to the lower surfaces of the locking portions 31A of the clamp pins 31, against which the peripheral edge 11*a* of the lens blank 1 on the concave surface 1*a* side abuts, as a reference height (the height of the block position $H_2$). Hence, a predetermined gap d (FIG. 5) is set between the lens blank 1 and lens holding unit 2, in other words, the thickness of the end of the wax 4 is set. More specifically, the gap d and a dripping amount Q of wax 4 are calculated from at least one of a thickness Te of the end of the wax 4 after spreading, the radius R of curvature of the concave surface 1*a* of the lens blank 1, the diameter LDb of the lens blank 1, a thickness YH of the peripheral portion of the lens holding unit 2 (in FIGS. 1 and 5, the thickness of the disk 2A from the rear surface 2*b* to the peripheral portion of the surface 2*a*), the diameter YDh of the lens holding unit 2, and the radius Ch of curvature of the convex surface 2*a* of the lens holding unit 2.

In the present invention, regarding the positional relationship between the lens holding unit 2 and lens blank 1 during block, a parameter "the thickness YH of the peripheral portion of the lens holding unit+the end thickness Te of the wax" is defined and set to 7 mm. The thickness YH of the peripheral edge of the lens holding unit 2 is set to 4 mm so that the end thickness Te of the wax 4 is set to 3 mm. Specific data is calculated by the following equations from respective parameter values sent upon request from a known server (not shown) that manages order data.

When the lens holding unit 2 is moved downward to press the wax 4 on the lens blank 1 in order to set the end thickness Te of the wax 4 to a predetermined value, the gap d in the vertical direction between the peripheral edge 11*a* of the lens blank 1 on the concave surface side and a peripheral edge 22*a* (FIG. 5) of the lens holding unit 2 on the blocking surface 2*a* side is calculated by the following equation (1):

$$d = -\sqrt{R^2 - \frac{LDb^2}{4}} + \sqrt{R^2 - \frac{YDh^2}{4}} \tag{1}$$

where R is the radius of curvature of the concave surface 1*a* of the lens blank 1, LDb is the diameter of the lens blank 1, and YDh is the diameter of the lens holding unit 2.

The coordinate position in the vertical direction of the peripheral edge 22*a* of the lens holding unit 2 on the blocking surface 2*a* side is located at a coordinate position which is below the reference surface 2*b* of the lens holding unit 2 by the predetermined value YH (the thickness of the peripheral portion). Hence, during block, the amount of downward movement of the lens holding unit 2 is controlled such that the end thickness Te of the wax 4 takes a predetermined value (3 mm in this embodiment). More specifically, the lens holding unit 2 is moved downward such that the reference surface 2*b* of the lens holding unit 2 stops at a position above the height of the block position $H_2$ (the height of the lower surfaces of the locking portions 31A of the clamp pins 31 against which the peripheral edge 11*a* of the lens blank 1 on the concave surface side abuts) by YH+d.

The dripping amount Q of wax 4 to be dripped onto the lens blank 1 is calculated by the following equation (2):

$$Q = \pi TeDh^2 + \pi\left[-\frac{1}{3}\left(R - \sqrt{R^2 - Dh^2}\right)^3 + R\left(R - \sqrt{R^2 - Dh^2}\right)^2\right] - \pi\left[-\frac{1}{3}\left(Ch - \sqrt{Ch^2 - Dh^2}\right)^3 + Ch\left(Ch - \sqrt{Ch^2 - Dh^2}\right)^2\right] \quad (2)$$

where Te is the end thickness of the wax 4, Ch is the radius of curvature of the blocking surface 2*a* of the lens holding unit 2, and 2Dh is the diameter of the wax 4 after spreading.

The dripping amount Q of wax 4 to be dripped onto the lens blank 1 can also be calculated by the following equation (3):

$$Q = \pi\left(Tc + \sqrt{R^2 - Dh^2} - \sqrt{Ch^2 - Dh^2}\right)Dh^2 + \pi\left[-\frac{1}{3}\left(R - \sqrt{R^2 - Dh^2}\right)^3 + R\left(R - \sqrt{R^2 - Dh^2}\right)^2\right] - \pi\left[-\frac{1}{3}\left(Ch - \sqrt{Ch^2 - Dh^2}\right)^3 + Ch\left(Ch - \sqrt{Ch^2 - Dh^2}\right)^2\right] \quad (3)$$

where Tc is the thickness of the center of the wax 4 after spreading.

When the dripping amount Q of wax 4 is calculated, the controller sends a predetermined number of pulses corresponding to it to the stepping motor 65 which controls the amount of rotation of the gear pump 64.

As the controller of the blocking device 10, a personal computer in which Windows 200 runs as the OS is employed. According to the communication method, an I/O board and motor controller are connected via an ArcNet communication board to control the centering device 13, dripping device 14, and gap setting device 15.

The block operation for the lens blank 1 by the blocking device 10 having the above structure will be described mainly with reference to FIG. 3 and FIGS. 9 to 12.

Figure 9:
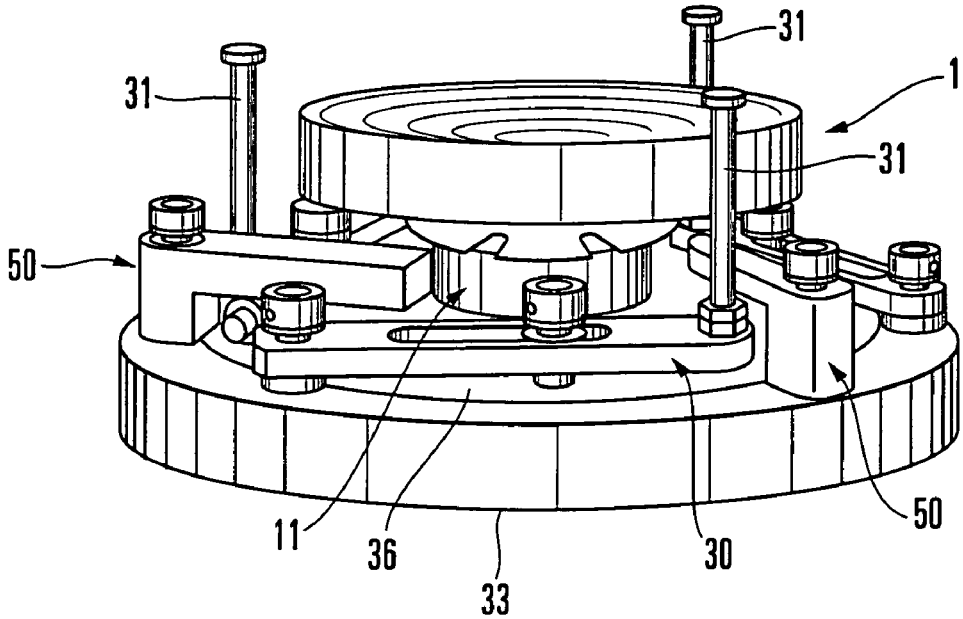
FIG. 9 is a view for explaining block operation for the lens blank.
Figure 10:
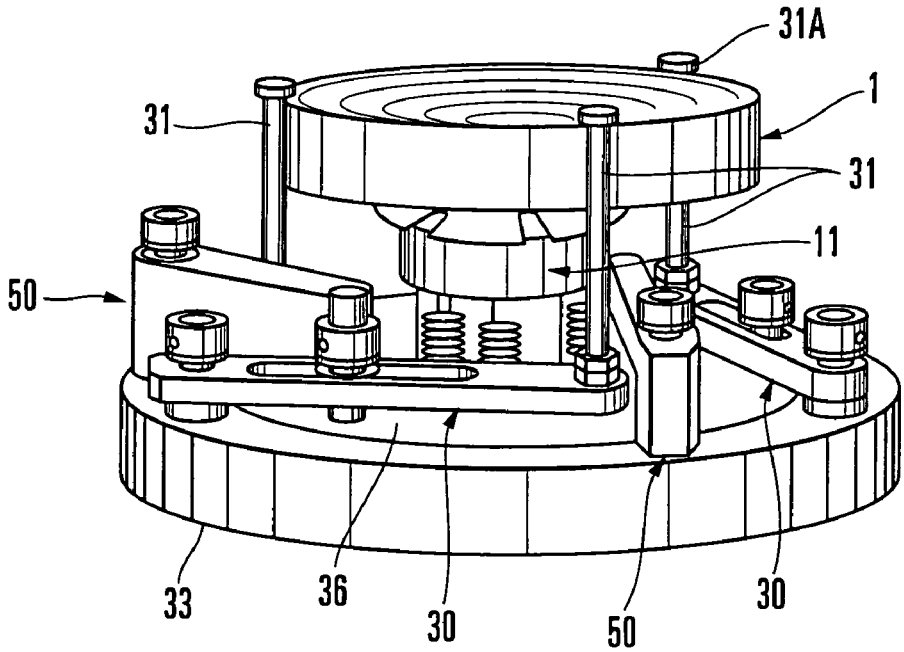
FIG. 10 is a view for explaining block operation for the lens blank.
Figure 11:
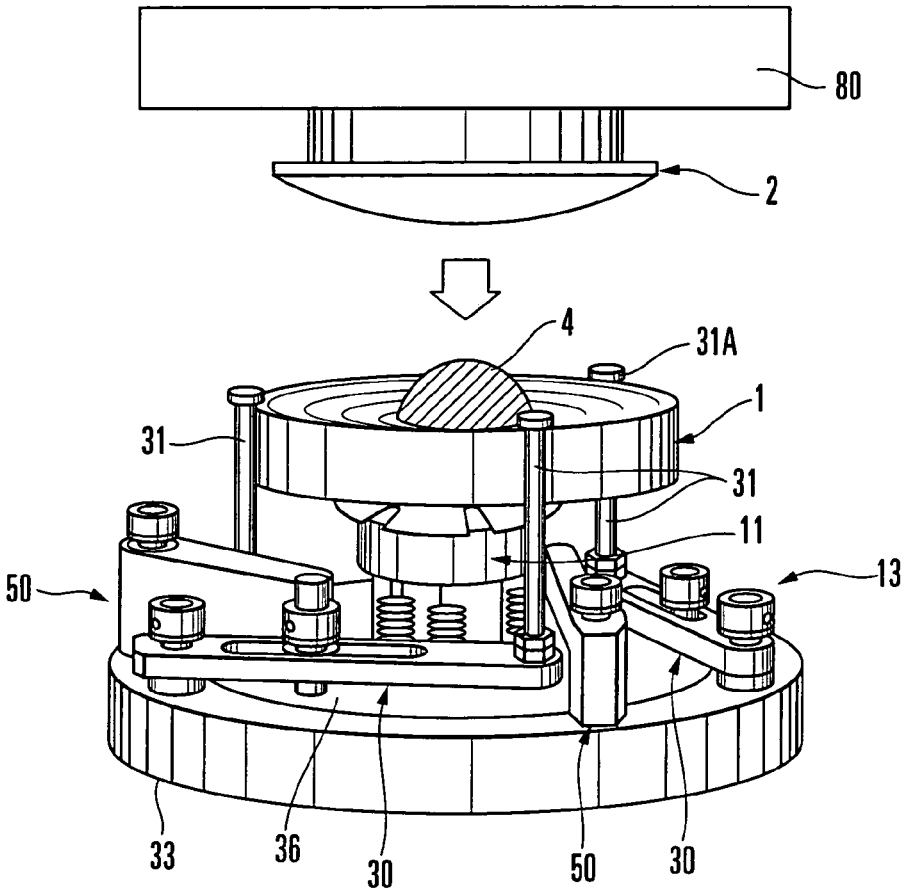
FIG. 11 is a view for explaining block operation for the lens blank.

First, the pad 19 is placed on the loading table 11 through the O-ring 18 (FIG. 3). The lens blank 1 is placed on the pad 19 with its concave surface 1*a* facing up (FIG. 9).

The lens holding unit 2 corresponding to the lens blank 1 is attached to the lower surface of the distal end of the holding arm 80 with its blocking surface 2*a* facing down (FIG. 4).

The lens blank 1 is centered by the centering device 13. In the centering operation, the air cylinder 39 is driven to drive the rotary base 36 through a predetermined angle in the direction of the arrow A in FIG. 3 to pivot the respective clamp members 30 in the closing direction indicated by the arrow B. Thus, the respective clamp pins 31 move toward the center of the rotary base 36 to press the peripheral surface 1*c* of the lens blank 1 so as to move the lens blank 1 in a direction opposite to the eccentric direction, so that the geometric center of the lens blank 1 coincides with the center of the loading table 11 (FIG. 4).

When the centering operation for the lens blank 1 is ended, the lens blank 1 is moved by the moving device 12 (FIG. 4) from the centering position $H_1$ to the block position $H_2$. More specifically, when the moving device 12 is driven, the operational rod 26 stretches to push up the support shaft 17 and loading table 11. The lens blank 1 thus moves upward from the centering position $H_1$ to the block position $H_2$ (FIG. 10) along the clamp pins 31, and the peripheral edge 11*a* on the concave surface 1*a* side is urged against the lower surfaces of the locking portions 31A of the clamp pins 31. Thus, the lens blank 1 is fixed at the block position $H_2$.

Subsequently, the slide plate 22 (FIG. 4) is moved leftward in FIG. 4 by a driving device such as an air cylinder to move the lens blank 1 from the block position $H_2$ to the dripping position $H_3$ (FIG. 2). When the lens blank 1 moves to the dripping position $H_3$ and stops, the dripping device 14 drips a predetermined amount of wax 4 onto the center of the concave surface 1*a* of the lens blank 1.

The wax 4 is dripped in the following manner as shown in FIG. 6. The stepping motor 65 is driven to drive the gear pump 64 for a predetermined period of time so as to push out a predetermined amount of wax 4 from the tank 61 to the pipe 63. With the pushing pressure, the wax 4 staying in the distal end of the pipe 63 drips in a predetermined amount from the nozzle 62 onto the concave surface 1*a* of the lens blank 1. At this time, the dripping valve 66 operates in synchronism with the gear pump 64 to open/close the nozzle 62.

Figure 12:
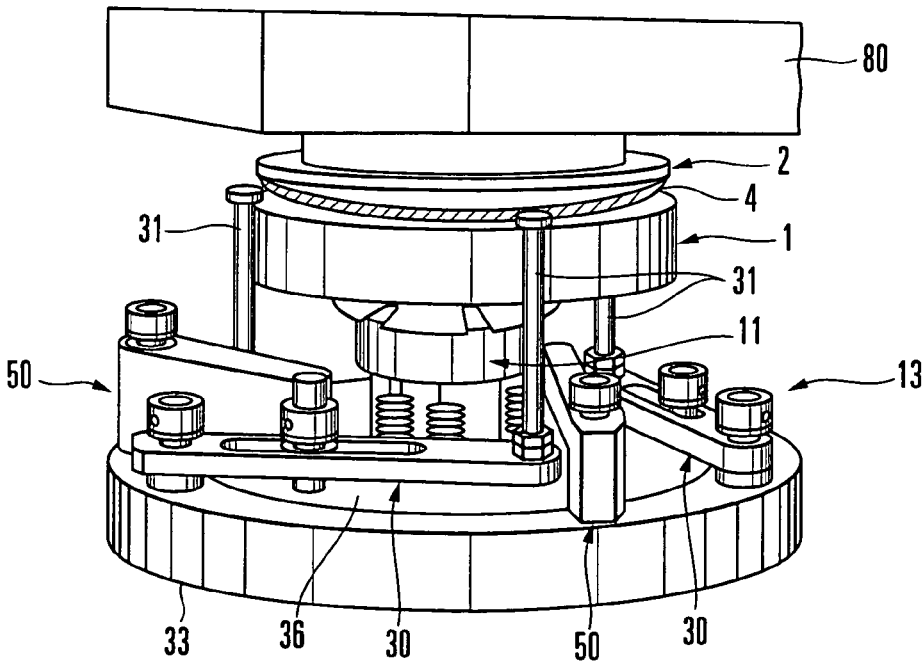
FIG. 12 is a view for explaining block operation for the lens blank.

When the dripping operation of the wax 4 by the dripping device 14 is ended, the slide plate 22 moves to restore the lens blank 1 from the dripping position $H_3$ to the block position $H_2$ again. When the lens blank 1 is restored to the block position $H_2$, the gap setting device 15 is actuated to move the holding arm 80 which holds the lens holding unit 2 downward by a predetermined amount (FIG. 11) to urge the blocking surface 2*a* of the lens holding unit 2 against the wax 4 which has dripped on the lens blank 1. Thus, the wax 4 spreads on the entire blocking surface 2*a* to have a predetermined thickness (FIG. 12). In this state, the wax 4 is cooled naturally for a predetermined period of time or forcedly to solidify so the lens blank 1 is blocked by the lens holding unit 2

After that, the respective clamp members 30 are pivoted outwardly in the direction of diameter of the rotary base 36 to separate the respective clamp pins 31 away from the lens blank 1. The holding arm 80 is moved upward to be restored to the initial height, and the loading table 11 is moved downward to be restored to the initial centering position $H_1$, thus ending the blocking operation for the lens blank 1 by the blocking device 10. The lens blank 1 which is blocked by the lens holding unit 2 has been placed on the loading table 11.

In this manner, according to the present invention, the dripping amount Q of wax 4 is controlled properly, and the amount of downward movement of the lens holding unit 2 is controlled such that the predetermined gap d is formed between the concave surface 1*a* of the lens blank 1 and the lens holding unit 2. The dripping amount Q of wax 4 will not be excessively large or excessively small, so the wax 4 can be spread into a predetermined thickness by the lens holding unit 2.

According to the present invention, during block, the lens blank 1 is moved upward from the centering position $H_1$ and then moved to the block position $H_2$. Whichever one of various types of lens blanks 1 having peripheral portions with different thicknesses may be employed, its concave surface 1*a* can be reliably positioned at the block position $H_2$.

According to the present invention, the centering device 13 has a simple arrangement with a small number of components, so it can be fabricated at a low cost.

According to the present invention, the loading table 11 is swingably supported by the swing means 20. Even when a lens blank having a peripheral portion with a thickness that changes in the circumferential direction is employed, its concave surface 1*a* can be maintained in the horizontal state.

During dripping the wax 4, the wax 4 will not overflow from the concave surface 1*a*, so the lens blank 1 can be blocked reliably.

According to the present invention, as the dripping amount of wax 4 can be controlled highly accurately, the wax 4 will not overflow from the concave surface 1*a* of the lens blank 3. Thus, the conventional blocking ring 3 shown in FIG. 13 is not required, so the number of components required for blocking can be decreased.

In the embodiment described above, polyethylene-based wax is employed. Any other wax, e.g., paraffin-based wax, microcrystalline-based wax, Fischer-Tropsh-based wax, or fats-and-oils-based synthetic wax can be employed as the bonding agent of the present invention as far as it is solid at room temperature and melts into liquid having a comparatively low viscosity when heated. Not only wax but also a low-melting alloy may also be employed.

The present invention is not limited to the embodiment described above, but various changes and modifications can be made.

INDUSTRIAL APPLICABILITY

Although a case has been described wherein the present invention is applied to blocking of a plastic spectacle lens, the present invention is not limited to this, but can be applied to various types of optical lenses.

The invention claimed is:

1. A device for blocking an optical lens, comprising a lens holding tool to which the optical lens is to be fixed through a bonding agent, characterized by comprising:

a loading table on which the optical lens is to be placed with a concave surface thereof facing up;

a centering device which causes a geometric center of the optical lens to coincide with a center of said loading table;

a dripping device which drips the bonding agent onto the concave surface of the optical lens;

a moving device which moves the optical lens to a block position of said lens holding tool; and a gap setting device which moves said lens holding tool and the optical lens in directions to relatively approach each other to set a predetermined gap therebetween, so that the bonding agent is spread, wherein a dripping amount Q of bonding agent is calculated by the following equation:

$$Q = \pi TeDh^2 + \pi\left[-\frac{1}{3}\left(R - \sqrt{R^2 - Dh^2}\right)^3 + R\left(R - \sqrt{R^2 - Dh^2}\right)^2\right] - \pi\left[-\frac{1}{3}\left(Ch - \sqrt{Ch^2 - Dh^2}\right)^3 + Ch\left(Ch - \sqrt{Ch^2 - Dh^2}\right)^2\right]$$

where where Te is the thickness of the peripheral portion of the bonding agent after spreading, Ch is the radius of curvature of a blocking surface of said lens holding tool, R is the radius of curvature of the concave surface of the optical lens, and 2Dh is the diameter of the bonding agent after spreading.

2. A device for blocking an optical lens according to claim 1, wherein said dripping device comprises a gear pump which supplies the bonding agent, a driving device which drives said gear pump intermittently, and a dripping device which drips the bonding agent supplied by said gear pump onto the concave surface of the optical lens.

* * * * *